US007142044B2

(12) United States Patent
Sano

(10) Patent No.: US 7,142,044 B2
(45) Date of Patent: Nov. 28, 2006

(54) VOLTAGE REGULATOR

(75) Inventor: Kazuaki Sano, Chiba (JP)

(73) Assignee: Seiko Instruments Inc. (JP)

( * ) Notice: Subject to any disclaimer, the term of this patent is extended or adjusted under 35 U.S.C. 154(b) by 84 days.

(21) Appl. No.: 10/942,453

(22) Filed: Sep. 16, 2004

(65) Prior Publication Data

US 2005/0068092 A1 Mar. 31, 2005

(30) Foreign Application Priority Data

Sep. 30, 2003 (JP) ..... 2003-341423

(51) Int. Cl.
*G05F 1/10* (2006.01)

(52) U.S. Cl. ..... 327/540; 327/541; 327/538; 327/539

(58) Field of Classification Search ..... 327/540, 327/541; 323/315, 316
See application file for complete search history.

(56) References Cited

U.S. PATENT DOCUMENTS 4,683,382 A * 7/1987 Sakurai et al. ..... 327/544
5,254,883 A * 10/1993 Horowitz et al. ..... 326/30
5,352,935 A * 10/1994 Yamamura et al. ..... 327/540
5,442,277 A * 8/1995 Mori et al. ..... 323/312
5,506,541 A * 4/1996 Herndon ..... 327/541
5,554,953 A * 9/1996 Shibayama et al. ..... 327/541
5,850,159 A * 12/1998 Chow et al. ..... 327/394
6,184,744 B1 * 2/2001 Morishita ..... 327/541
6,194,887 B1 * 2/2001 Tsukada ..... 323/315
6,313,694 B1 * 11/2001 Sohn ..... 327/541
6,456,155 B1 * 9/2002 Takai ..... 327/541
6,661,279 B1 * 12/2003 Yabe ..... 327/546
6,882,187 B1 * 4/2005 Kim et al. ..... 327/112

* cited by examiner

*Primary Examiner*—Tuan T. Lam
*Assistant Examiner*—Hiep Nguyen
(74) *Attorney, Agent, or Firm*—Adams & Wilks

(57) ABSTRACT

The present invention provides a voltage regulator capable of causing a large output current to flow during a heavy load operation, and of making a leakage current from output transistors small during a light load operation. The voltage regulator includes a plurality of output transistors and a circuit for changing connection of the output transistors to allow a W/L value of the output transistor to be changed. Moreover, the voltage regulator further includes an output current detection circuit for detecting an output current, and a circuit for changing connection of the output transistors based on the output current to allow a W/L value of the output transistors to be changed based on the output current.

12 Claims, 3 Drawing Sheets

VOLTAGE REGULATOR

BACKGROUND OF THE INVENTION

1. Field of the Invention

The present invention relates in general to a voltage regulator, and more particularly to a voltage regulator capable of decreasing a leakage current from output transistors when a load is light.

2. Description of the Related Art

As shown in FIG. 3, a conventional voltage regulator includes a voltage regulator control circuit having a reference voltage circuit 2, bleeder resistors 6 and 7 for voltage-dividing an output voltage Vout appearing at an output terminal 5 of the voltage regulator, and an error amplifier 3 for amplifying a voltage difference between a reference voltage Vref from the reference voltage circuit 2 and a voltage Va appearing at a node between the bleeder resistors 6 and 7, and an output transistor 4. The voltage regulator operates at a power supply voltage VDD supplied from a voltage source 1.

When an output voltage of the error amplifier 3 is assigned Verr, if the voltage Va is larger than the reference voltage Vref, the output voltage Verr becomes higher, while if the voltage Va is smaller than the reference voltage Vref, the output voltage Verr becomes lower. When the output voltage Verr of the error amplifier 3 becomes higher, the output transistor 4 becomes larger with its ON resistance to serve to decrease the output voltage Vout. On the other hand, when the output voltage Verr of the error amplifier 3 becomes lower, the output transistor 4 becomes smaller with its ON resistance to serve to increase the output voltage Vout. The voltage regulator control circuit holds the output voltage Vout constant by those mechanisms.

Since resistance values of the bleeder resistors 6 and 7 are generally set to very large values, the voltage regulator controls the output transistor 4 so that the ON resistance of the output transistor 4 becomes very large when a load is light (e.g., refer to JP 07-74976 B (FIG. 2)).

However, if the output transistor 4 is so controlled that its ON resistance becomes very large when the load is light, there is encountered a problem in that an influence of a leakage current from the output transistor 4 becomes larger and hence the output voltage Vout cannot be held constant. In general, when a channel width and a channel length of a transistor are assigned W and L, respectively, a W/L value is reduced to allow a leakage current from the transistor to be reduced. In this case, however, an amount of current which can be caused to flow when a load is heavy becomes lesser accordingly.

SUMMARY OF THE INVENTION

In light of the foregoing, the present invention has been made in order to solve the above-mentioned problems associated with the prior art, and it is therefore an object of the present invention to provide a voltage regulator capable of causing a large leakage current to flow when a load is heavy, and of making a leakage current from output transistors small when a load is light.

In order to attain the above-mentioned object, a voltage regulator according to the present invention includes a plurality of output transistors and a circuit for changing connection of the output transistors, in which a W/L value of the output transistors can be changed.

Moreover, a voltage regulator according to the present invention includes an output current detection circuit for detecting an output current and a circuit for changing connection of the output transistors based on the output current, in which a W/L value of the output transistors can be changed based on the output current.

According to the voltage regulator of the present invention, the control is carried out such that the W/L value of the output transistors become smaller when a load is light without reducing an amount of current which can be caused to flow when a load is heavy, whereby it is possible to reduce a leakage current from the output transistors when the load is light.

DESCRIPTION OF THE PREFERRED EMBODIMENTS

First Embodiment

Figure 1:
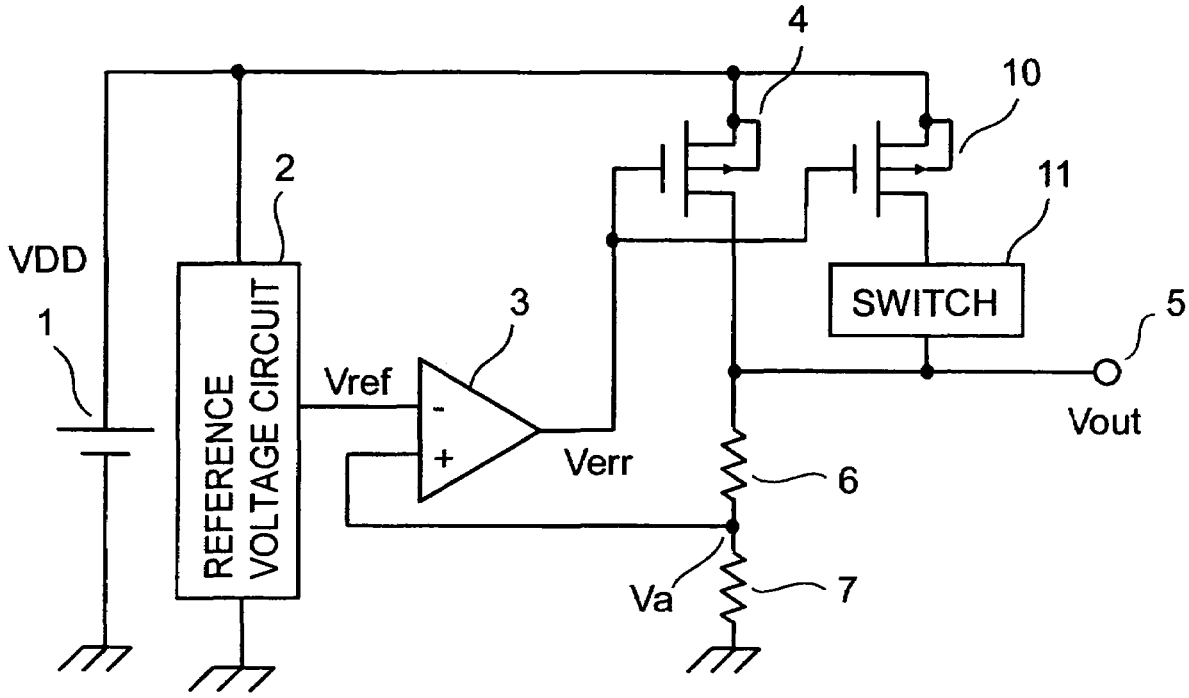
FIG. 1 is a circuit diagram of a voltage regulator according to a first embodiment of the present invention.

FIG. 1 is a circuit diagram of a voltage regulator according to a first embodiment of the present invention. The voltage regulator according to the first embodiment of the present invention includes a voltage regulator control circuit having a reference voltage circuit 2, bleeder resistors 6 and 7 for voltage-dividing an output voltage Vout of the voltage regulator, and an error amplifier 3 for amplifying a voltage difference between a reference voltage Vref from the reference voltage circuit 2 and a voltage Va appearing at a node between the bleeder resistors 6 and 7, output MOS transistors 4 and 10 connected in parallel, and a switch 11 for changing the effective W/L value (W is a channel width and L is a channel length) of the output transistors.

The switch 11 operates so as to be turned ON during a normal load operation and so as to be turned OFF during a light load operation.

When the switch 11 is turned ON, the output transistors 4 and 10 are both in output operation, and hence a W/L value of the output transistors becomes a sum of W/L values of both the output transistors 4 and 10. Consequently, during the normal load operation in which an output current is large, the W/L value of the output transistors becomes larger than that of the output transistors during the light load operation, and hence a large current can be caused to flow with the output transistors 4 and 10.

On the other hand, when the switch 11 is turned OFF, only the output transistor 4 is in output operation and hence the W/L value of the output transistors becomes equal to the W/L value of the output transistor 4. Thus, during the light load operation in which the output current is small, the W/L value of the output transistors becomes smaller than that of the output transistors during the normal load operation, and hence a leakage current from the output transistors becomes smaller.

Consequently, during the heavy load operation, the large output current can be caused to flow, while during the light load operation, the leakage current from the output transistors can be reduced.

Second Embodiment

Figure 2:
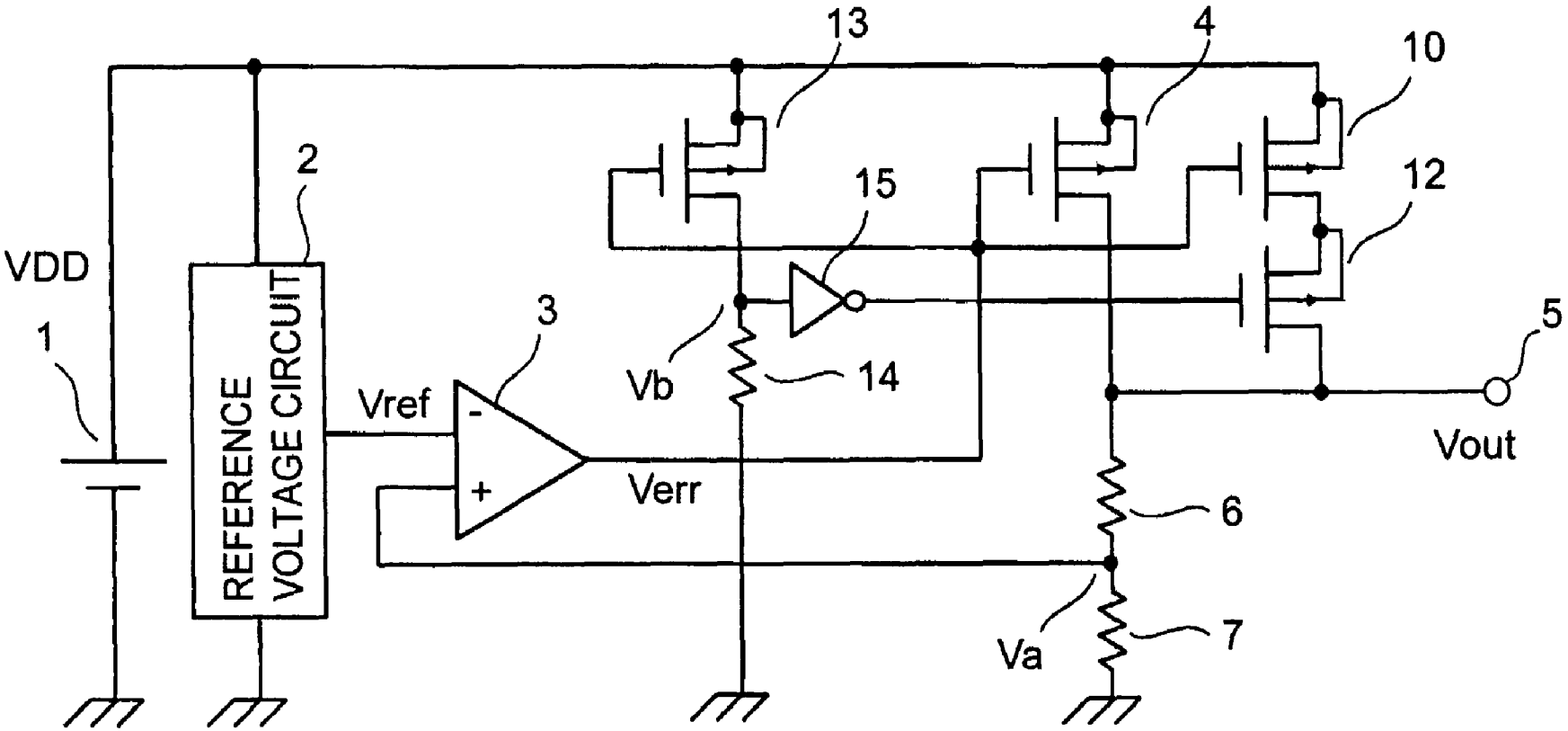
FIG. 2 is a circuit diagram of a voltage regulator according to a second embodiment of the present invention.
Figure 3:
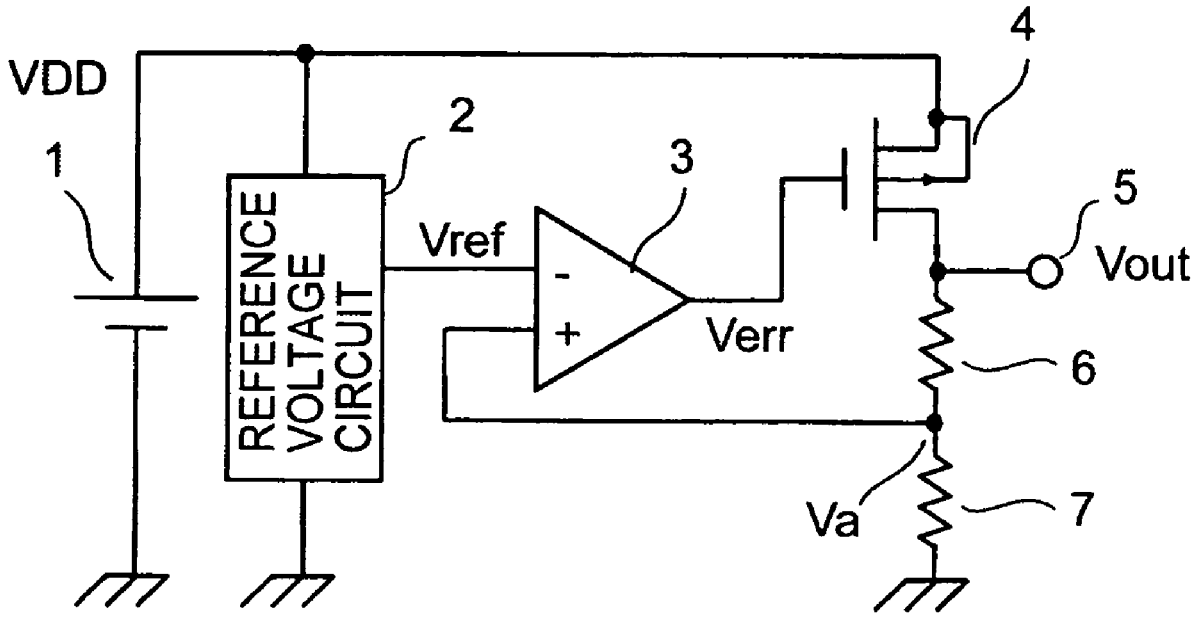
FIG. 3 PRIOR ART
FIG. 3 is a circuit diagram of a conventional voltage regulator.

FIG. 2 is a circuit diagram of a voltage regulator according to a second embodiment of the present invention. The voltage regulator according to the second embodiment of the present invention includes a voltage regulator control circuit having a reference voltage circuit 2, bleeder resistors 6 and 7 for voltage-dividing an output voltage Vout of the voltage regulator, and an error amplifier 3 for amplifying a voltage difference between a reference voltage Vref from the reference voltage circuit 2 and a voltage Va appearing at a node between the bleeder resistors 6 and 7, output MOS transistors 4 and 10 connected in parallel, and a switching MOS transistor 12 for changing the effective W/L value of the output transistors.

A W/L value of the output transistors is changed by the switching transistor 12. The switching transistor 12 is controlled by an output current detection circuit including a transistor 13 connected in parallel with the output transistors 4 and 10, an output current sense resistor 14, and an inverter 15.

During a normal load operation, a current is caused to flow between a drain and a source of the transistor 13 in correspondence to an output current. A drain-to-source current of the transistor 13 is caused to flow through the output current sense resistor 14 to raise an input voltage Vb to the inverter 15. As a result, a gate voltage of the switching transistor 12 decreases to turn ON the switching transistor 12. Turn-ON of the switching transistor 12 results in that the W/L value of the output transistors becomes a sum of the W/L values of the output transistors 4 and 10. Consequently, during the normal load operation in which the output current is large, the W/L value of the output transistors becomes larger than that of the output transistors during the light load operation, and hence a large current can be caused to flow with the output transistors 4 and 10.

During the light load operation, the control is carried out so that the output transistor 4 is turned OFF. Thus, the current caused to flow between the drain and the source of the transistor 13 becomes smaller to reduce the input voltage Vb to the inverter 15. As a result, a gate voltage of the switching transistor 12 increases to turn OFF the switching transistor 12. Turn-OFF of the switching transistor 12 results in that the W/L value of the output transistors becomes equal to the W/L value of the output transistor 4. Thus, during the light load operation in which the output current is small, the W/L value of the output transistors becomes smaller than that of the output transistors during the normal load operation, and hence a leakage current from the output transistors becomes smaller.

Consequently, during the heavy load operation, the large output current can be caused to flow, while during the light load operation, the leakage current from the output transistors can be reduced.

In addition, a resistance value of the output current sense resistor 14, and an inversed voltage of the inverter 15 are changed, thereby making it possible to change a value of an output current with which the switching transistor 12 is turned OFF.

What is claimed is:

1. A voltage regulator comprising:

a first output MOS transistor connected between a voltage source and an output terminal;

a second output MOS transistor connected between the voltage source and the output terminal;

a voltage dividing circuit connected between the output terminal and ground;

a reference voltage circuit;

an error amplifier having inputs connected with an output of the reference voltage circuit and an output of the voltage dividing circuit, and having an output connected with a gate of the first output MOS transistor and a gate of the second output MOS transistor;

an output current detection circuit connected between the voltage source and ground and having an input connected with an output of the error amplifier; and a switch connected between the second output MOS transistor and the output terminal and controlled by the output current detection circuit based on an output current of the output terminal.

2. A voltage regulator according to claim 1; wherein the output current detection circuit includes a transistor connected in parallel with the first and second output MOS transistors, and an output current sense resistor.

3. A voltage regulator according to claim 2; wherein the switch comprises a MOS transistor having a gate connected with an output of the output current detection circuit.

4. A voltage, regulator according to claim 3; wherein the gate of the MOS transistor of the switch is connected to a node between the transistor and the output current sense resistor of the output current detection circuit.

5. A voltage regulator according to claim 4; wherein the output current detection circuit includes an inverter connected between the node and the gate of the MOS transistor of the switch.

6. A voltage regulator according to claim 1; wherein the switch comprises a MOS transistor having a gate connected with an output of the output current detection circuit.

7. A voltage regulator comprising:

a first output MOS transistor connected between a voltage source and an output terminal;

a second output MOS transistor connected between the voltage source and the output terminal;

a voltage dividing circuit connected between the output terminal and ground;

a reference voltage circuit;

an error amplifier having inputs connected, respectively, to an output of the reference voltage circuit and an output of the voltage dividing circuit, and having an output connected to a gate of the first output MOS transistor and a gate of the second output MOS transistor;

an output current detection circuit that detects an output current of the output terminal; and a switch connected between the second output MOS transistor and the output terminal and operative to connect and disconnect the second output MOS transistor to and from the output terminal based on the output current detected by the output current detection circuit.

8. A voltage regulator according to claim 7; wherein the output current detection circuit includes a transistor connected in parallel with the first and second output MOS transistors, and an output current sense resistor.

9. A voltage regulator according to claim 8; wherein the switch comprises a MOS transistor having a gate connected with an output of the output current detection circuit.

10. A voltage regulator according to claim 9; wherein the gate of the MOS transistor of the switch is connected to a node between the transistor and the output current sense resistor of the output current detection circuit.

11. A voltage regulator according to claim 10; wherein the output current detection circuit includes an inverter connected between the node and the gate of the MOS transistor of the switch.

12. A voltage regulator according to claim 7; wherein the switch comprises a MOS transistor having a gate connected with an output of the output current detection circuit.

* * * * *